United States Patent [19]

Gabriel

[11] Patent Number: 5,074,608

[45] Date of Patent: Dec. 24, 1991

[54] TONGS-LIKE CARGO-HOOK DEVICE WITH AUTOMATIC LOADING FEATURES

[76] Inventor: Edwin Z. Gabriel, 91 Mt. Tabor Way, Ocean Grove, N.J. 07756

[21] Appl. No.: 535,979

[22] Filed: Jun. 11, 1990

Related U.S. Application Data

[63] Continuation-in-part of Ser. No. 380,663, Jul. 17, 1989, abandoned.

[51] Int. Cl.[5] ..... B66C 1/38

[52] U.S. Cl. ..... 294/82.32; 294/82.3; 294/88; 294/110.1; 294/118

[58] Field of Search ... 294/75, 76, 82.18, 82.24–82.27, 294/82.3–92.34, 88, 110.1, 118; 24/598.5, 599.1, 599.4–599.9, 600.3

[56] References Cited

U.S. PATENT DOCUMENTS

| | | | |
|---|---|---|---|
| 274,189 | 3/1883 | Hadlock | 294/82.32 |
| 1,471,094 | 10/1923 | Bloss | 294/82.32 |
| 1,507,706 | 9/1924 | Miller et al. | 294/82.32 |
| 2,213,014 | 8/1940 | Owen | 294/88 |
| 2,383,485 | 8/1945 | Irby | 294/82.32 |
| 2,476,734 | 7/1949 | Jellison | 294/82.32 |
| 2,732,245 | 1/1956 | Lemoigne | 294/82.25 |
| 3,853,082 | 12/1974 | Rosenberg et al. | 294/82.32 X |
| 4,717,189 | 1/1988 | Gabriel | 294/82.32 |

FOREIGN PATENT DOCUMENTS

| | | | |
|---|---|---|---|
| 844546 | 7/1981 | U.S.S.R. | 294/82.32 |

*Primary Examiner*—Johnny D. Cherry

[57] ABSTRACT

This improved cable-scooping hook device is capable of automatically loading and unloading cargo, used for transporting suspended cargo. It comprises two relatively flat members, pivoted by a pin near their mid-section and weighted on top to help force its lower portions to separate when the cargo is lowered onto a platform and the hoist cable tension is reduced. Its lower mating ends or jaws are protected from high compressive stresses by inwardly protruding hammers. To prevent the hook device from tipping over upon touchdown, at least one swivable tubular support member staddles the device. For secure suspended cargo retention, its lower portions may have an integrated electromagnet producing lines of force when energized to keep its jaws engaged. The weights on top can be reduced using springs to counter the closing torque about the pivot pin, to enable the device's lower portions to disengage automatically. The addition of a tongue fastened to the underside of a selected jaw assists in scooping up a load cable. The tubular support member's legs may be flexible in length.

12 Claims, 16 Drawing Sheets

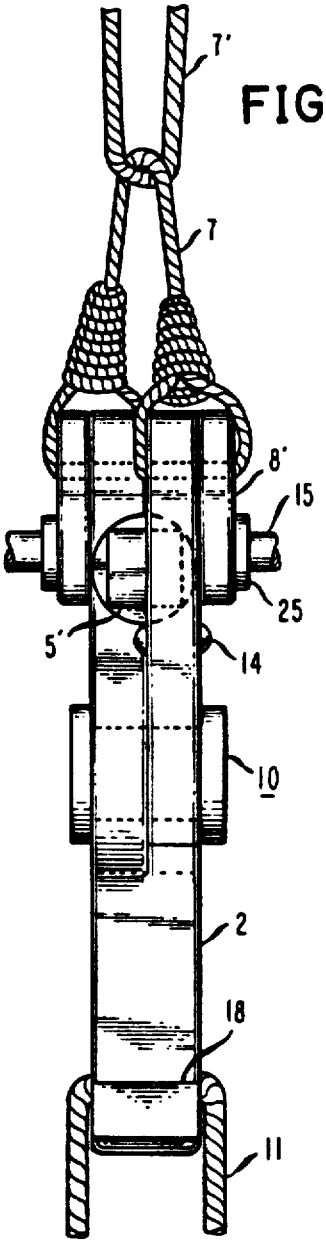
FIG. 2
FIG. 4
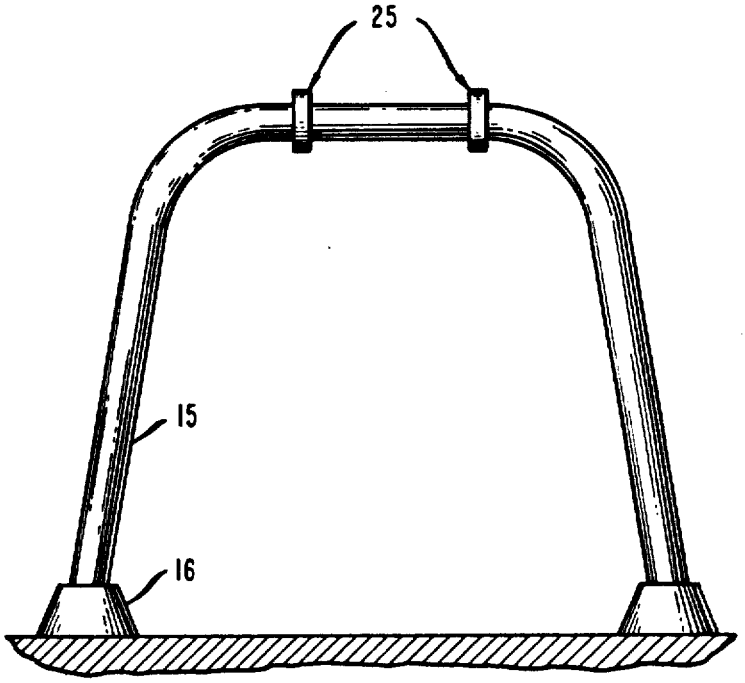

TONGS-LIKE CARGO-HOOK DEVICE WITH AUTOMATIC LOADING FEATURES

BACKGROUND OF THE INVENTION

This application is a continuation-in-part of my copending application Ser. No. 380,663, filed July 17,1989, now abandoned.

This invention is in the field of material handling, primarily related to cargo hooks. A previous patent U.S. Pat. No. 4,717,189 by Gabriel also describes a tongs-like cable-scooping device having some of the features of the present invention. For example, it has hammerheads and an electromagnet for accomplishing positive load retention but the weaknesses in the prior invention are overcome in the present one; the present one representing a significant improvement for accomplishing remote loading and unloading of cargo reliably, safely, dependably and inexpensively for both light and very heavy loads.

In the past, the operation of loading cargo has been a manual one, a hazard to personnel in such situations as loading an offshore heaving, swaying ship. Ship personnel have had to manually place a ring attached to a cable onto a cargo hook, for cargo to be lifted by a hoist cable and placed elsewhere. In addition, remote unloading has been performed by applying a signal to a solenoid, as in the case of the Breeze-Eastern cargo hook. Should there be an open circuit between the switch and the solenoid, cargo would be incapable of remotely unloading. Should the application be to suspend cargo from a helicopter, a hazardous environmental condition could exist when manually loading cargo. Toxic waste sites also present a hazard for manually loading and unloading of cargo, such as drums. In other hazardous operations, ammunition and toxic chemicals may need to be transported to another site. It would be safer and less time-consuming not to use ground personnel and use the proposed hook instead.

Presently, Breeze-Eastern, Union, N.J., supplies the military with complex cargo hooks, capable of unloading cargo remotely with the application of a signal to a solenoid within the hook enclosure. Unfortunately, none of their cargo hooks can remotely snatch up a load cable. For remote releasing of cargo, the Breeze hook requires 22-28 VDC at 12 to 15 amperes, for release at dropping capacity for a typical 6000-LB load, and a minimum release load of 7 Lbs for 1⅜ inch travel of the rotatable hook portion, according to their specifications. In comparison, the proposed cargo-hook requires 1 ampere at the same voltage to produce a jaws' closing force of 10 Lbs.

The weaknesses of prior patent U.S. Pat. No. 4,717,189 are: 1. The hook device cannot maintain erectness when lowered onto a platform, thus being less able to scoop up a load cable; 2. When the electromagnet becomes an integral part of a hammerhead, the ability of the head to withstand horizontal stress forces is lessened, since the protruding extension is weakened. 3. Its ability to adequately scoop up a load cable repeatedly is questionable.

SUMMARY OF THE INVENTION

This device is capable of quickly scooping up a load cable from a supporting structure, such as a platform, and releasing the load cable tied to a load. The device has two elongated members, pivoted near their mid-section by a pivot pin, for use with hoist cables and a load cable. These members have upper and lower portions, each having an exterior surface and each upper portion having a weight to assist in forcing the separation of these portions upon touchdown of the load. The device's lower portions have complementary-shaped ends, which engage when supporting cargo, because of the tension on the hoist cables. Also assisting in separating the lower portions is an extension spring having one end fastened to the underside of one of the upper portions and its other end fastened to the exterior surface of a lower portion. Each upper portion has an inside surface with a bar fastened horizontally to the inside surface; each bar has a hammerhead extending inward toward the other hammerhead, so that, when abutting and supporting cargo, the hammerheads share the structural stress imposed on the complementary-shaped ends. A flat thin springy sheet or a steel tongue attached to the underside of a jaw and extending to the adjacent jaw can assist in properly and repeatedly scooping up a load cable.

The novel, patentable improvements include the addition of a support tubular swivable member to enable the device to stand upright after having discharged a load cable, and prevent it from toppling over. A spring can assist in unloading the cargo and a simplified relocated electromagnet assures positive load retention. The addition of one or more coil springs can assist in separating the device's jaws when the load makes contact with a rigid surface, enabling the use of lighter weights in the device's upper portions. In addition, one or both of the device's lower portions have an integrated electromagnet producing magnetic lines of force when energized, for positive load retention, utilizing the device's configuration to form a closed magnetic loop.

The electromagnet of the proposed cargo hook requires approximately 0.75 ampere to produce a jaw's closing force of 5 Lbs. for positive load retention of cargo. The current magnitude would increase only slightly with cargo load magnitudes, as the current requirement is dependent essentially on the hook's weight, not on the load's magnitude. Even without an electromagnet, the hook maintains engagement as long as a load is suspended and hanging, while the electromagnet prevents the load cable for releasing even when cargo is not in suspension. The improvements proposed in this invention are novel and significantly useful for reducing the device's weight, for enabling automatic scooping of the load cable and for simplifying its design, while AC voltage may be applied to the electromagnet via a double-pole, double-throw switch to destroy or remove the residual magnetism in the device's lower portions, when positive load retention is no longer required.

For positive load retention capability, the jaws in one version of the cargo hook are redesigned so that it is unnecessary to apply ac voltage to the electromagnet's coil to demagnetize the high-strength ferrous steel.

BRIEF DESCRIPTION OF DRAWINGS

For the purpose of illustrating the invention, the following drawings show forms which are presently preferred. It is understood, however, that this invention is not necessarily limited to the precise arrangement, instrumentalities and field of utility as therein demonstrated:

FIG. 2 is a side view thereof.

FIG. 4 is a front detail view of the tubular support member.

DESCRIPTION OF A PREFERRED EMBODIMENT

Figure 1:
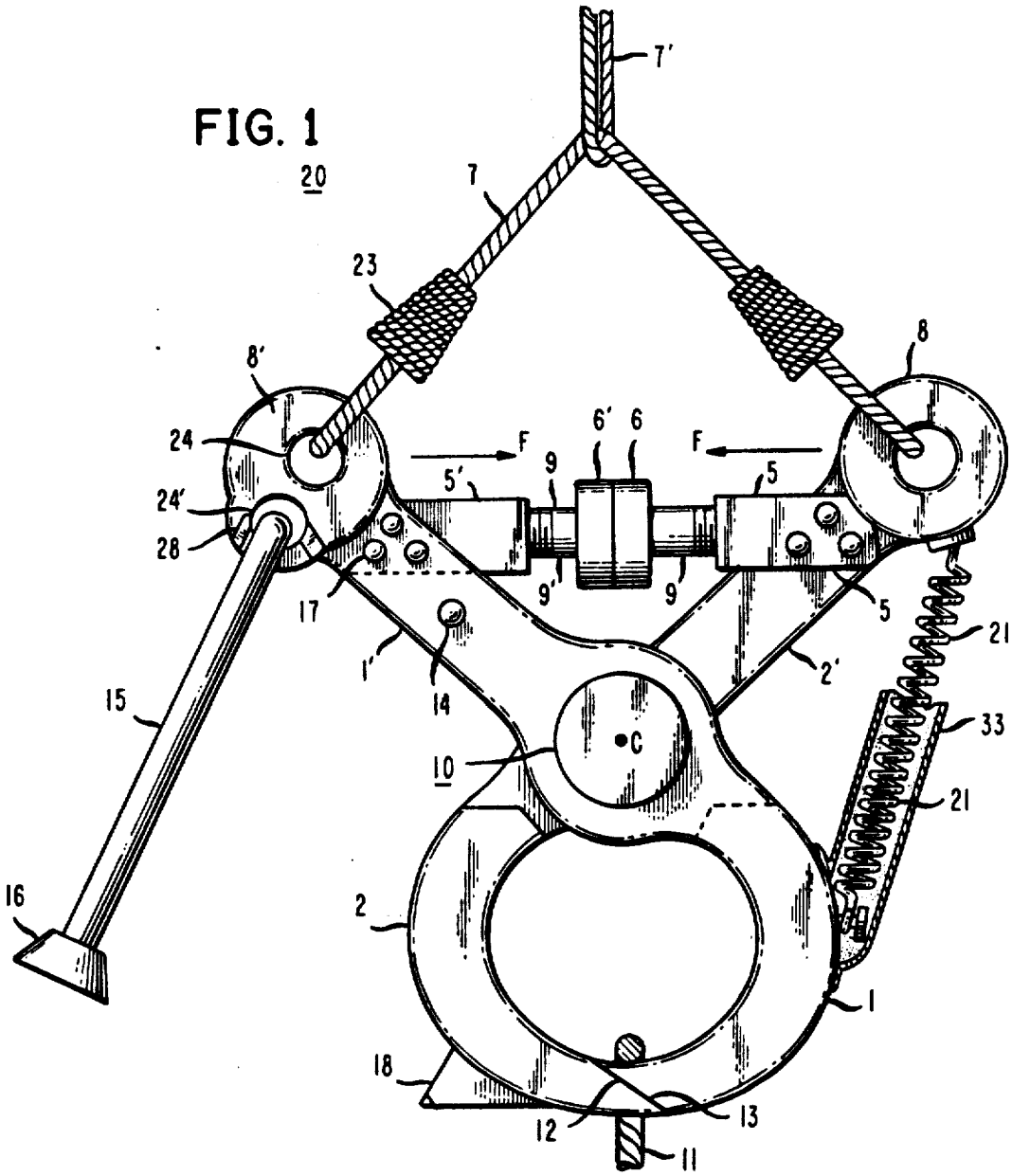
FIG. 1 is a front assembly view of a cargo hook device with attached hammerheads in upper portions and an extension coil spring to assist in separating the device's jaws upon slackening of its hoist cables. A swivable tubular support member prevents the device from toppling over upon its making contact with a flat rigid surface.
Figure 3:
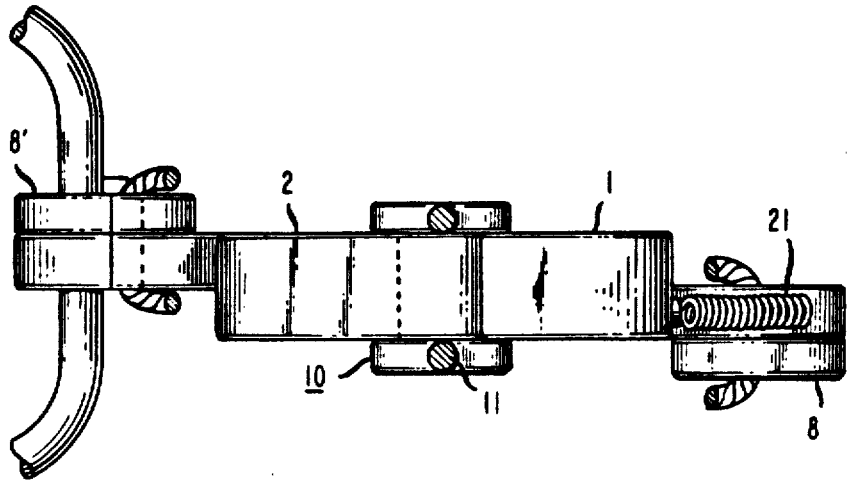
FIG. 3 is a bottom view thereof.
Figure 5:
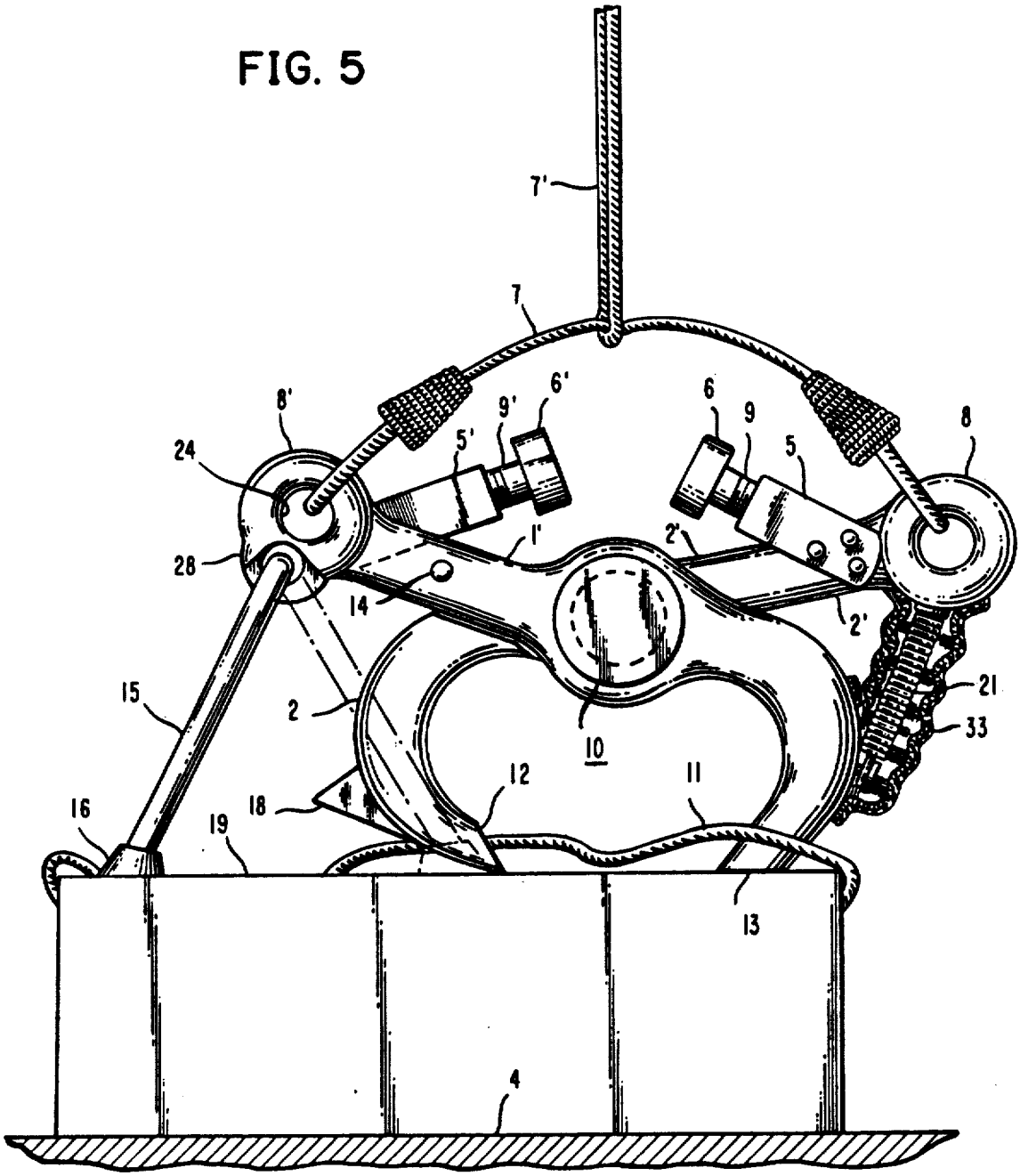
FIG. 5 is a front assembly view of the device of FIG. 1 with its lower portions separated and the load cable discharged.

Cargo hook device 20 is a significantly improved version of a cable-scooping, hoist cable coupling device described in patent U.S. Pat. No. 4,717,189, better able to snatch up a cable, without being more complex overall. FIGS. 1, 2 and 3 show a version of device 20 with bars 5 and 5' with attached hammerheads 6 and 6' via threaded portions 9 and 9'. Elongated members 1 and 2 are pivoted together by pin 10. Lower portions 1 and 2 overlap at ends 12 and 13, identified more clearly in FIG. 5. Upper portions 1' and 2' have weights 8 and 8' of sufficient magnitude to assure that device 20 will separate its jaws at touchdown without aid of the spring 21, should the spring fail function. However, for many applications using a spring of suitable strength, weights 8 and 8' would be unnecessary, at least not of such magnitude as shown. In FIG. 1 device 20 is shown attached to cables 7 and 7' and suspended. Hand-spliced eyes and thimbles 23 are shown. However, a shackle could be mounted more simply in hole 24. Hole 24' has been provided for tubing member 15 in addition to hole 24 for cable 7, so the two do not interfere with the other's function. Upper portion 1' may need to be strengthened to assure that the desired suspended cargo could be carried. The strength of tubing or tubular support member, or tubular, inverted U-shaped standard 15 need be only such as to support device 20 and any dynamic force encountered, and prevent it from toppling over on its side. Member 15 is capable of swiveling inside of hole 24' with stops 28 for limiting angular movement to about 60° C. Extension spring 21, with one end attached to upper portion 2' and its other end attached to the outer surface of portion 1, assists in separating lower portions 1 and 2 upon touchdown of load 3, FIG. 5. Spring 21 can be protected from dirt by having an elastic or fabric sleeve 33, FIGS. 1 and 5, treated to be impervious to water. A very flexible, lightweight sleeve 33 could be fastened air tight to the underside of weight 8 at one end and to the exterior of lower portion 1, as shown, to protect spring 21 from the elements. Spring covering or sleeve 33 for spring 21 can protect the spring's coils from mud, small rocks, dirt and chemicals that could damage, possibly corrode the coils, thus disabling spring 21 from functioning as designed. A sleeve with a glossy surface would permit dirt, mud and destructive toxic chemicals to be washed off more easily with a hose. Without sleeve 33, dirt and toxic chemicals could get in between the coils and be difficult to remove; possibly cause the coils to stick together, thus preventing the extension spring from stretching. Tubing 15's both ends have resilient hoofs 16. Now to prevent cable 11 from being snatched up again when lifting device 20, the device is tilted backwards, resting upon wedge 18 and rotated just slightly, while simultaneously tubular member 15 swivels forward automatically, as shown in dashed lines, FIG. 5. Then hoist cable 7' can lift device 20 without snatching cable 11.

In previous patent U.S. Pat. No. 4,717,189, when an integrated electromagnet was designed into bar 5', a soft steel structure essentially was employed. Hammerheads 6 and 6' also were of soft steel, depending on the design scheme used. In device 20, both bars and hammerheads are of high strength stainless steel, thereby having the capability of suspending heavier loads. Threads in horizontal bars 9 and 9' permit adjustment of distance between heads 6 and 6' so that contact is just made between ends 12 and 13 when a load is suspended, if that is what is desired. Once properly adjusted, the threaded portions could be welded in place to bars 5 and 5'.

Figure 12B:
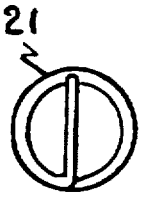
FIG. 12B is an end view thereof.
Figure 12A:
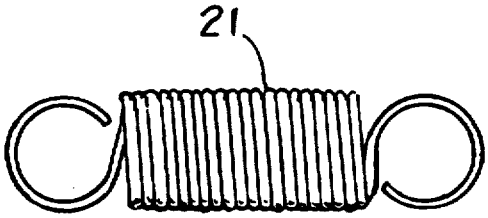
FIG. 12A is a front view of an extension spring.

As previously mentioned, spring 21, FIG. 1, performs the function of opening jaws' ends 12 and 13 the instant that tension is relieved in hoist cables 7 and 7'. Thus, while device 20 is suspended, tension in spring 21 is present at all times. Detail drawing of spring 21 is shown in FIGS. 12A and 12B.

Figure 32:
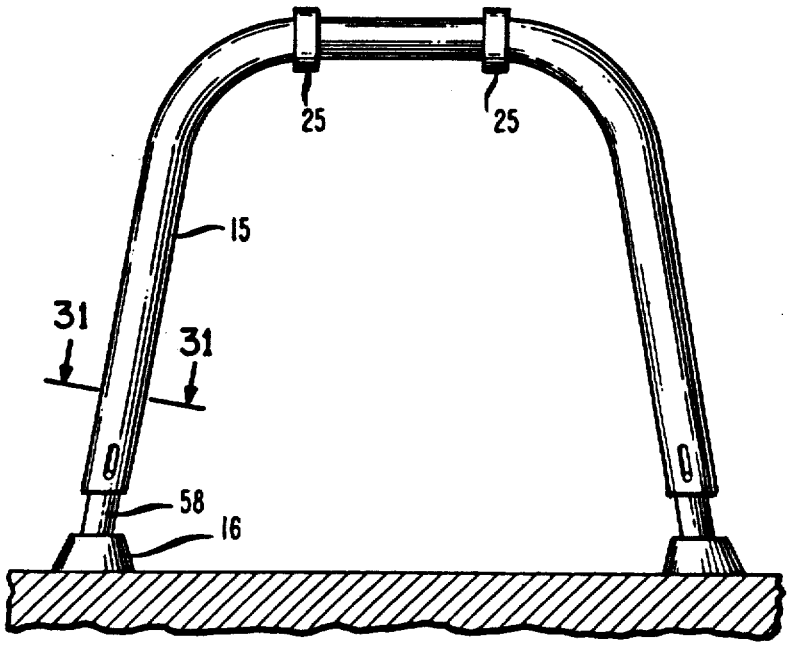
FIG. 32 is a front elevational view of the tubular support members, showing legs of the tubing spread apart to assist in keeping the device erect.

As mentioned previously, to prevent device 20 from toppling over upon touchdown of load 3, bent tubular support member 15 is provided. Legs of member 15 may be spread slightly apart to assist in providing better support for device 20. In FIG. 32, retainer rings 25 fixed to tubular member 15 help keep the support member somewhat symmetrically in place, allowing sufficient clearance from faces of the upper portion to be swivable. Rings 25 restrain movement of tubing 15 horizontally. An Oilite self-lubricating bearing, not shown, provides less friction for oscillatory movement of tubing or tubular member 15.

Such bushings and bearings are described in detail under bearings in Marks' "Standard Handbook for Mechanical Engineers". Tubing retainers 25 are not shown in any of the other figures except in FIGS. 4 and 32 to avoid complicating the drawings. Such bearings and bushings may be used for pin 10, too, with consideration for the loading factor.

With low friction inside of hole 24', tubing 15 will swing downward by gravity's force when lifting hook 20, and swing upward to provide uprightness to hook 20 upon touchdown. However, should it be required that tubing 15 not move angularly more than, say 60°, stops 28 could be fastened to the surface of weight 8', FIG. 1.

Figure 9:
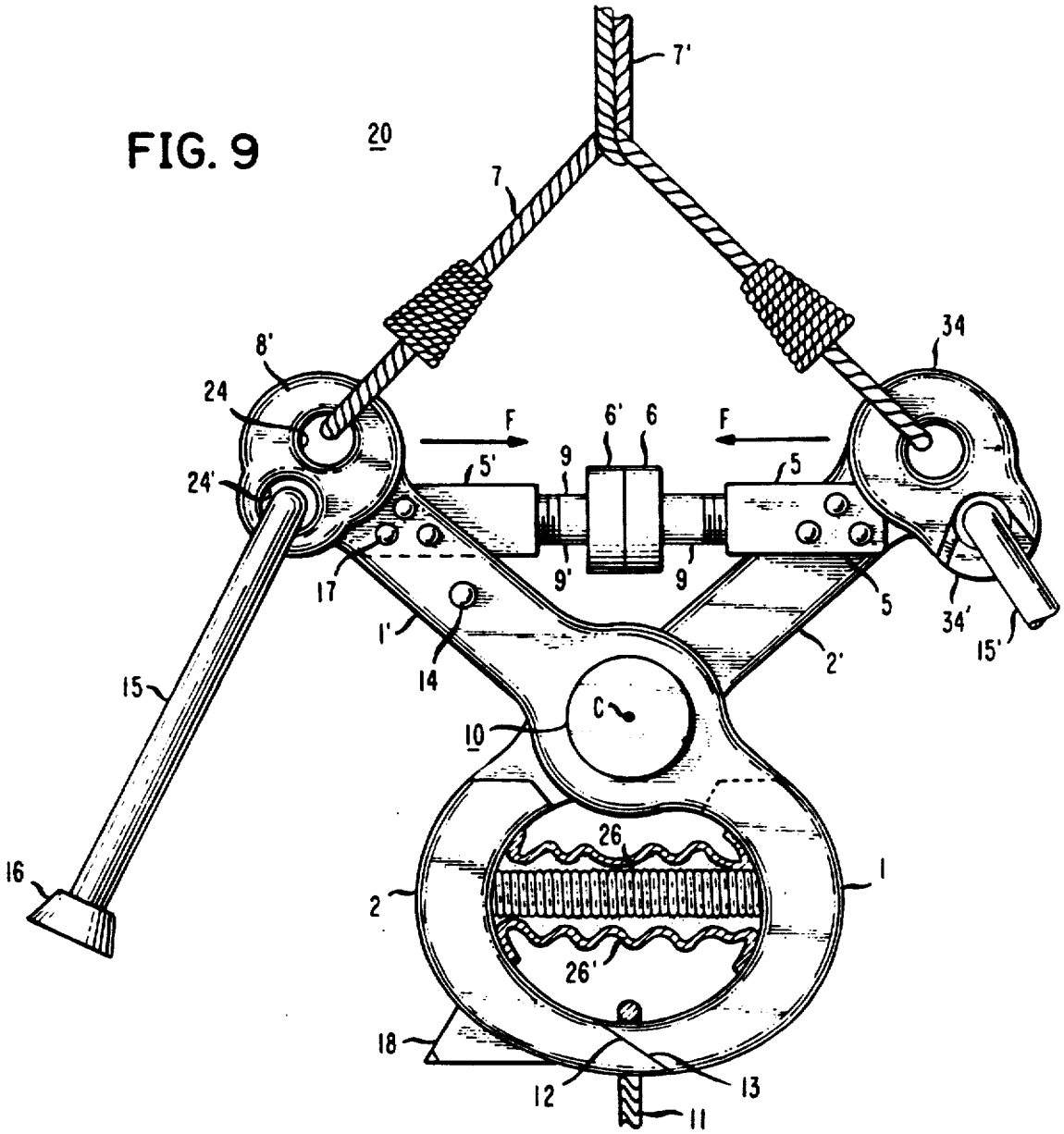
FIG. 9 is a front assembly view of the closed cargo hook device of FIG. 1 showing a commpression spring located between its lower portions and under stress and replacing the extension spring.
Figure 9A:
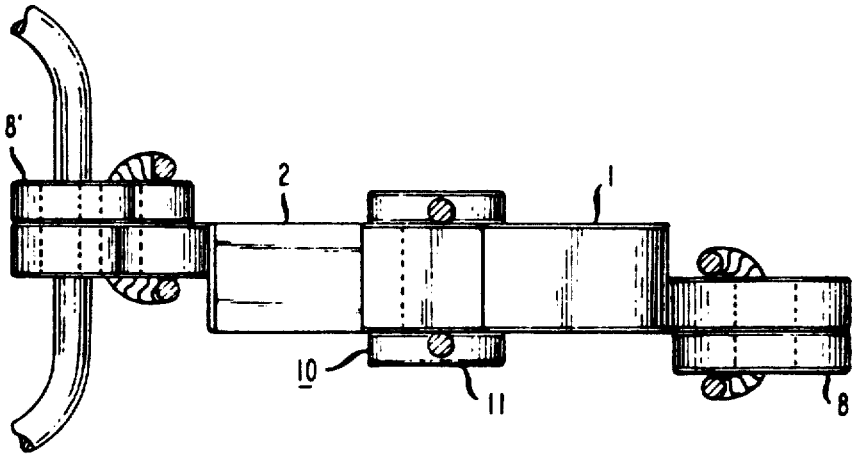
FIG. 9A is a bottom view thereof.
Figure 13B:
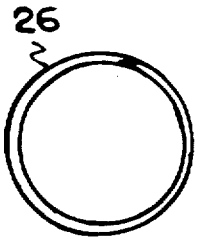
FIG. 13B is an end view thereof.
Figure 13A:
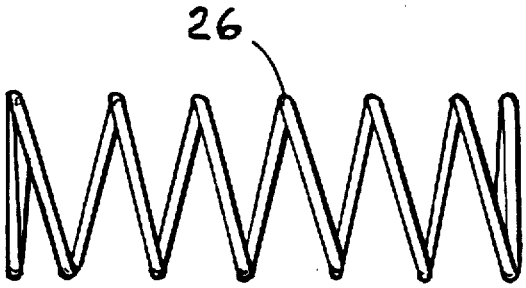
FIG. 13A shows a front view of a compression spring.

In place of extension spring 21, a compression spring 26, FIG. 9, may be used to perform the function of forcing lower portions 1 and 2 to separate the instant cable 7 becomes slack, the spring being suspended between inner surfaces of the lower portions, as shown. One end of spring 26 may be fastened by a screw to the inside surface of lower portion 1 and its other end similarly fastened to the inside surface of portion 2. Spring 26 is under compressive stress while suspending a load, urging the two lower portions to separate with a desired force, for which spring 26 is designed, to include any friction in the pivot pin bearing and the net torque being exerted about pivot center C by weights 8 and 8'. A detail drawing of compression spring 26 is shown in FIGS. 13A and 13B. Elastic, glossy protective sleeve 26' keeps dirt from forming on spring 26.

Figure 6A:
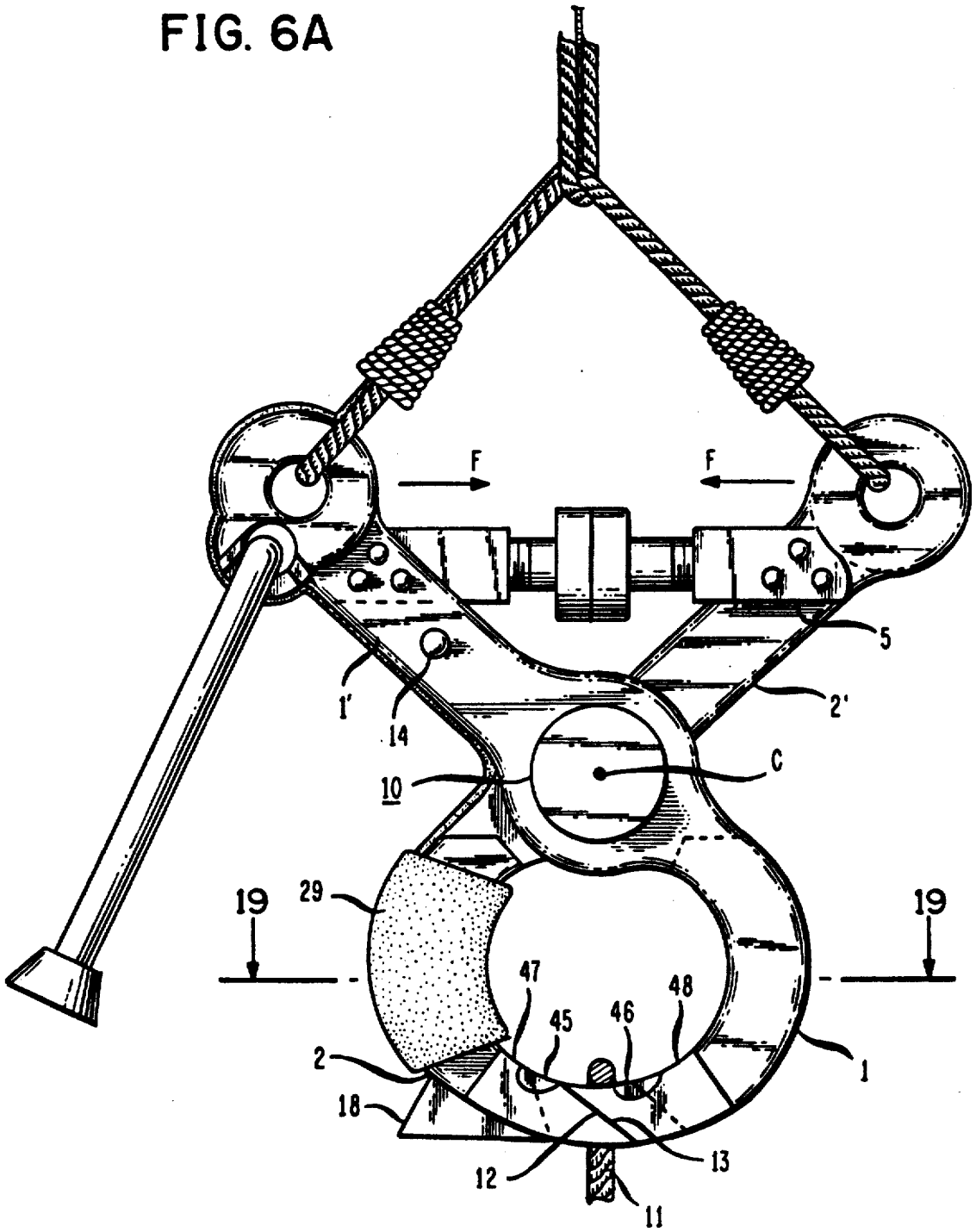
FIG. 6A is a front assembly view of the cargo hook device with modified jaws so that when voltage is applied to its coil and then removed, very little residual magnetism remains at its jaw's ends.
Figure 6:
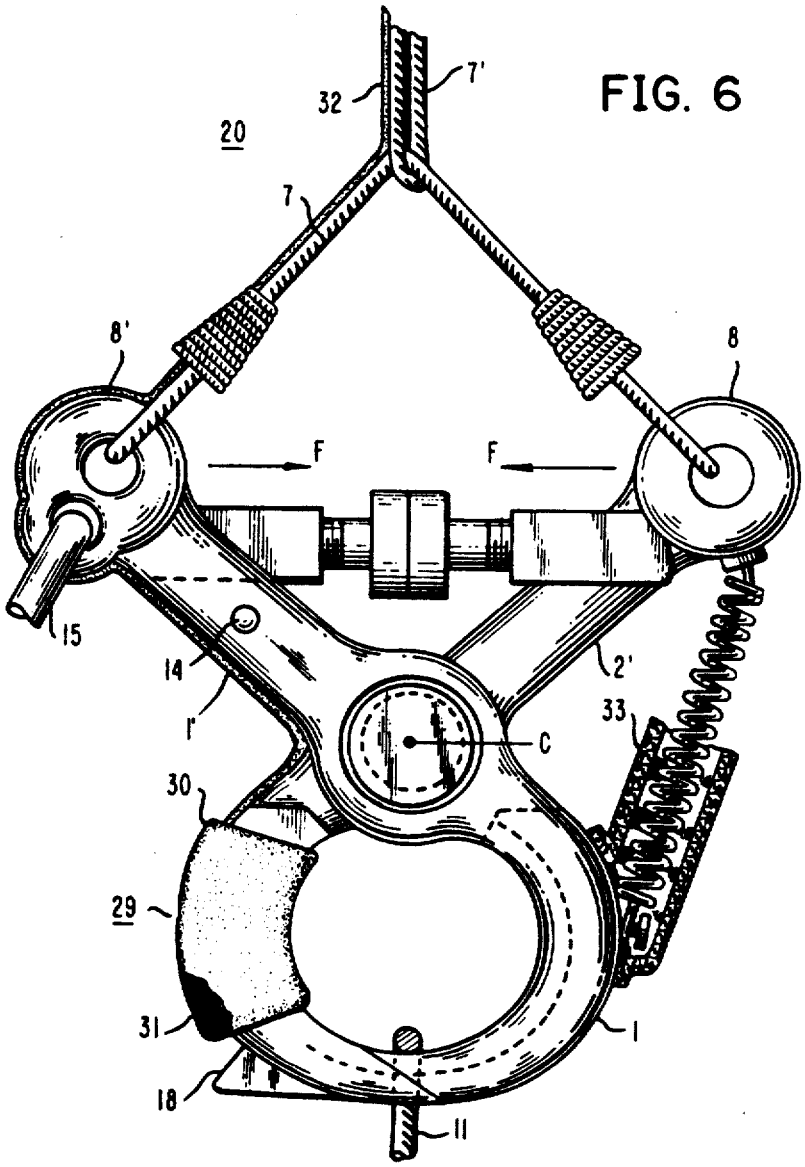
FIG. 6 is a front assembly view of the closed hook device showing the location of an electromagnet for positive retention of cargo.
Figure 7A:
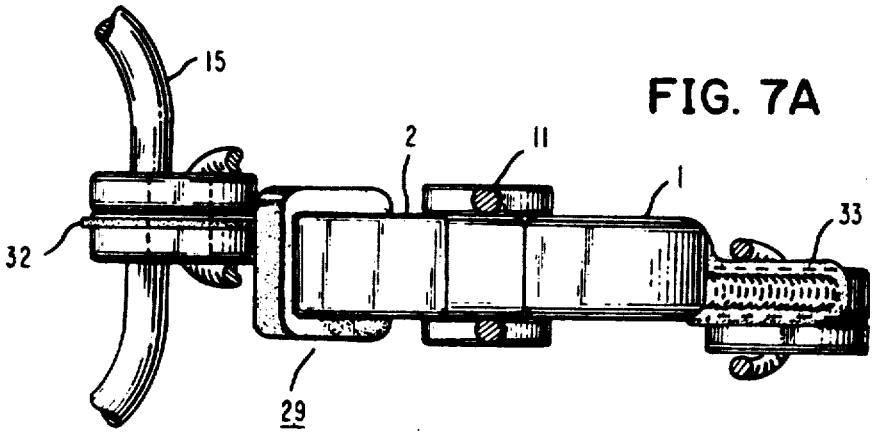
FIG. 7A is a bottom view thereof.
Figure 10:
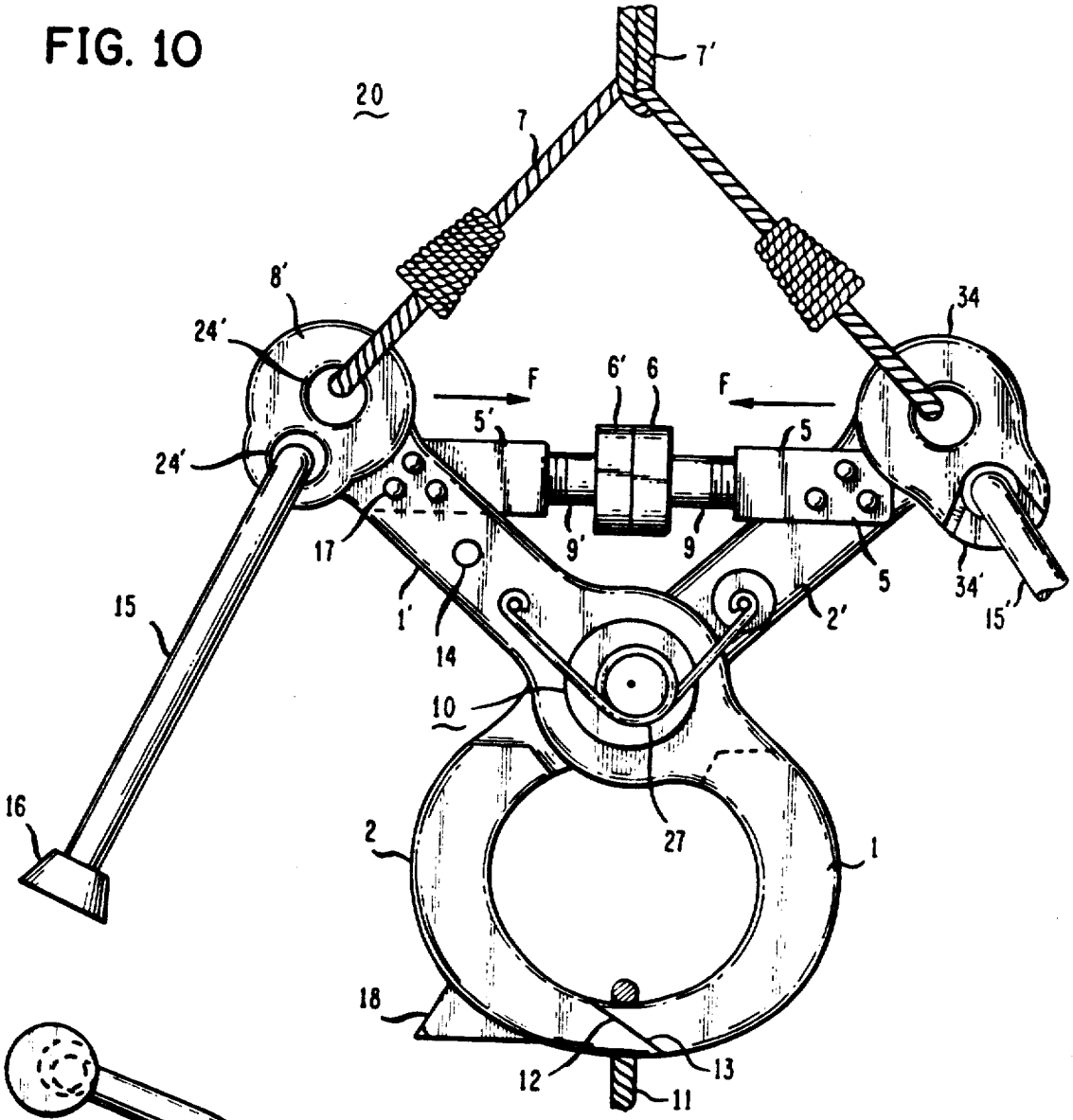
FIG. 10 is a front assembly view of the closed cargo hook of FIG. 1, showing a torsion spring under stress at the pivot pin's location.
Figure 11:
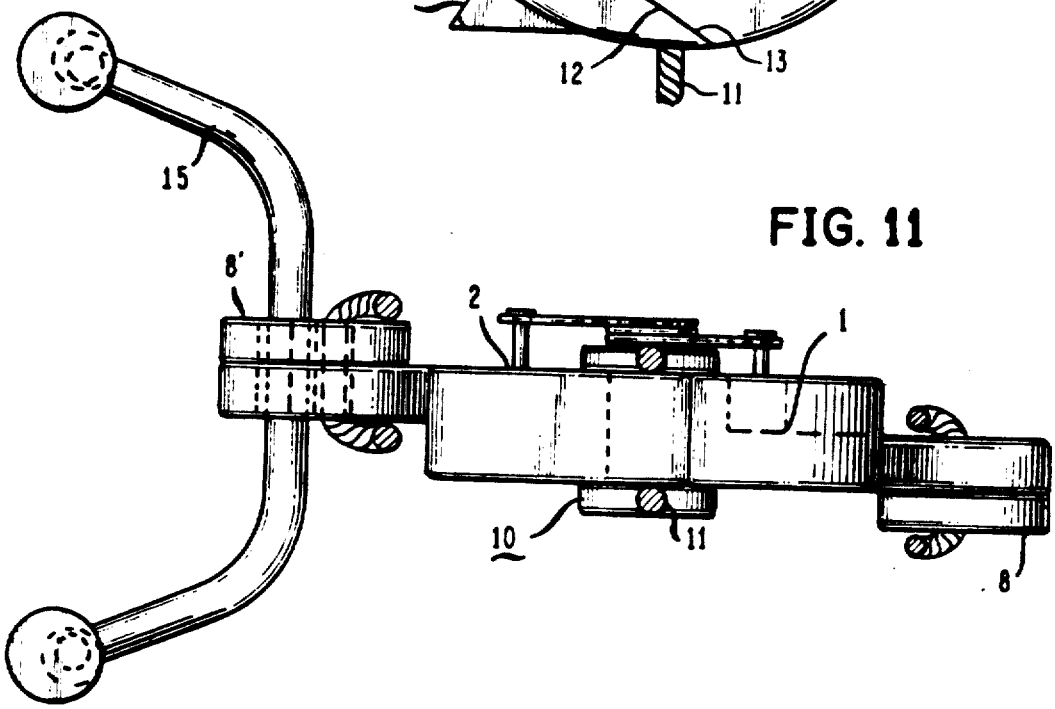
FIG. 11 is a bottom view thereof.
Figure 14A:
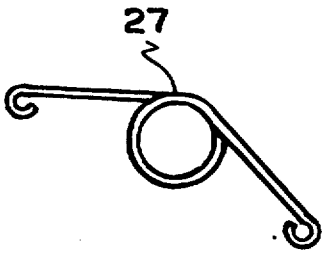
FIG. 14A shows a front view of a torsion spring.
Figure 14B:
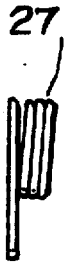
FIG. 14B is an end view thereof.

Finally, in place of extension spring 21, torsion spring 27, FIG. 10, may be used to perform the function of forcing lower portions 1 and 2 to separate the instant hoist cable 7 becomes slack. The spring is now being suspended between outside surfaces of lower portions 1 and 2 near and in front of pivot pin 10. Imbedded cylinder 41, FIG. 10, is of electrically non-conductive material. Its ends are fastened to each portion 1' and 2', as shown in FIG. 10. Such a spring is manufactured by Murphy & Read Manufacturing Co., Palmyra, N.J. 08065. Detail drawings of torsion spring 27 are shown in FIGS. 14A and 14B. Springs shown in the figures are not drawn to scale; and the sleeves in FIGS. 6 and 9 are shown in cross section.

Figure 8:
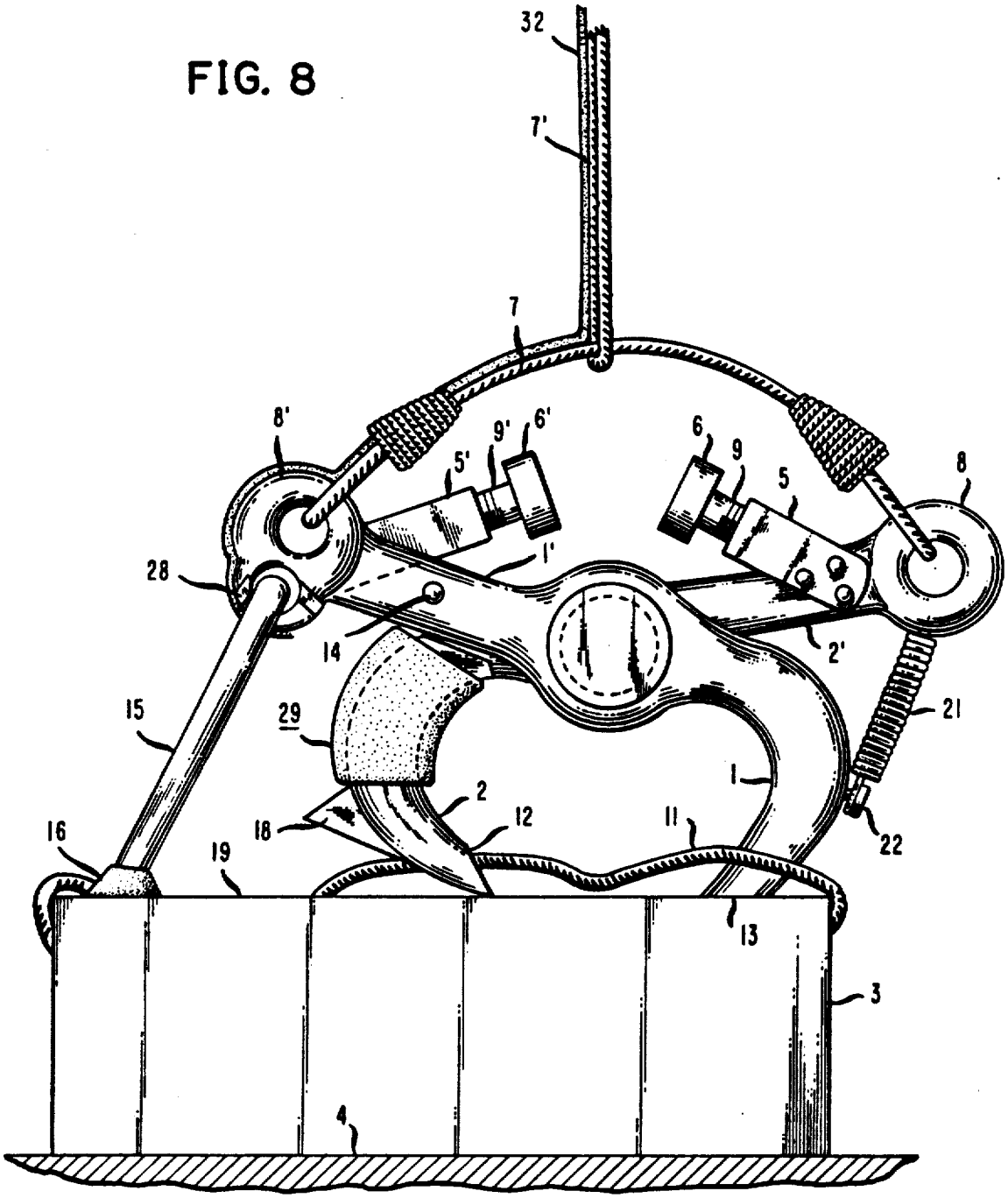
FIG. 8 is a front assembly view of FIG. 7 showing the device's jaws separated and resting on a platform.

To provide positive load retention of cable 11, FIG. 1, under all environmental conditions, electromagnet 29 is provided to cause jaws of lower portions 1 and 2 to remain closed by magnetic force, when energized. Lower portion 2 could be considered to be the core for the ferrous metal loop, along with portion 1 and the hub surrounding pin 10. It is irrelevant whether portions 1' and 2' and the hammerheads are considered also as another loop. Magnetic lines will take the path of least reluctance, thus allowing most lines 42 of magnetic force to remain in the lower loop. If it is desire to keep the lines from traveling through the upper loop completely, horizontal bars 5 and 5' and/or hammerheads 6 and 6' may be of non-magnetizable stainless steel. It should be mentioned that if compression spring 26 is used where shown in FIG. 9, electromagnet coil assembly 29 would not be used. If 10 pounds of magnetic force is desired to keep the device's lower ends 12 and 13 in contact, then 200 ampere-turns for the winding would be required; or 200 turns of insulated wire with a DC current of 1 ampere flowing. Size AWG #24 wire would be adequate for winding 31 of assembly 29, shown in FIGS. 6 and 8, having protective non-magnetizable covering 30. Wires 32, supplying voltage to coil 31, follow upper portion 1', around ring 8', cable 7 to hoist cable 7', then to a power supply source 38, FIG. 17, via switches 36 and 37. Should only 5 lbs. of magnetic force be required to produce the desired effect of keeping the device's jaws engaged, then the current required would be approximately 0.75 ampere for the same 200 turns of wire.

Figure 17:
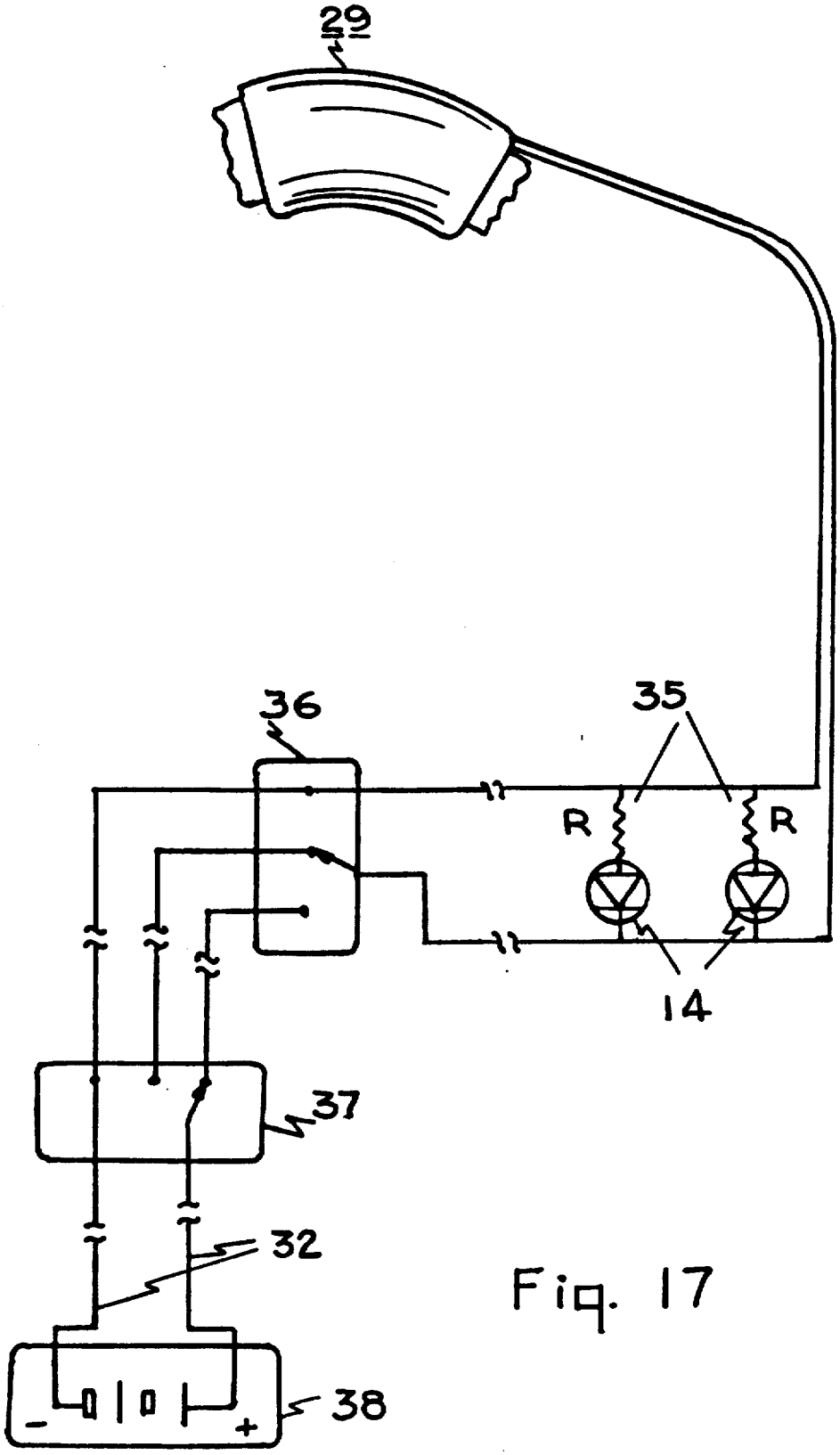
FIG. 17 is an electrical schematic of the circuitry for the electromagnet component shown in FIG. 6.

To describe the operation of the electromagnet circuit, FIG. 17, a simple circuit is provided with switches 36 and 37 and light emitting diodes 14. Once in a close position, jaws 1 and 2 are maintained in contact under all environmental conditions of load suspension until either switch 36 or 37 is toggled. In FIG. 17, voltage from source 38 is applied to coil 29 assembly, via insulated wires 32. Both three-way switches 36, 37 could be located remotely, convenient to those operating the hoist mechanism. In FIG. 17, with the load suspended, by flipping switch 36, the electromagnet coil winding is activated and magnetic lines of force pass through its steel core, forming a closed loop, as shown in dashed lines, FIGS. 6 and 15. Light emitting diodes (LEDs) 14 located on the front and rear of hook 20 illuminate when coil 31, FIG. 6, is energized, informing the operator that the device's electromagnet 29 or 29' is energized and device 20 has positive load retention. Resistors 35 limit the current through diodes 14 to acceptable magnitudes. When it is desired to unload cargo 3, either switch 36 or 37 is flipped; then diodes 14 are no longer illuminated. The magnetic path is identified by numeral 42.

The electromagnet coils 29' of insulated wire can be protected from the elements by an electrical sealant, such as Dow Corning 738 sealant for bonding and sealing electrical parts. Then to prevent static electricity from being stored on any of the surfaces of hook 20, the device could be painted or sprayed with a coating that would make it static-free. Such sprays are manufactured by Phillips ECG Co., Division of North American Phillips Corp., and by LPN Engineering Plastics, Malvern, PA. Wires 40, FIG. 15, interconnect coils 29'.

Figure 18:
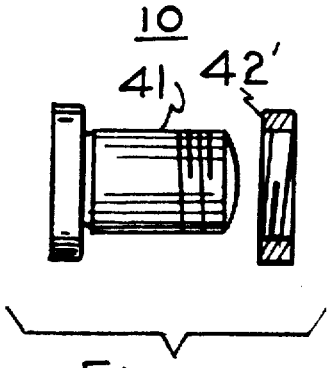
FIG. 18 is a side view of both the pivot pin and its nut.

As an additional remark, the construction of this cargo hook device 20 lends itself to being a natural core for an electromagnet, provided the ferrous metal used has low reluctance to magnetic lines of force. It should be added that a detail drawing of pivot pin 10 is shown in FIG. 18, showing pin 41 and nut 42', both being side views.

Figure 7:
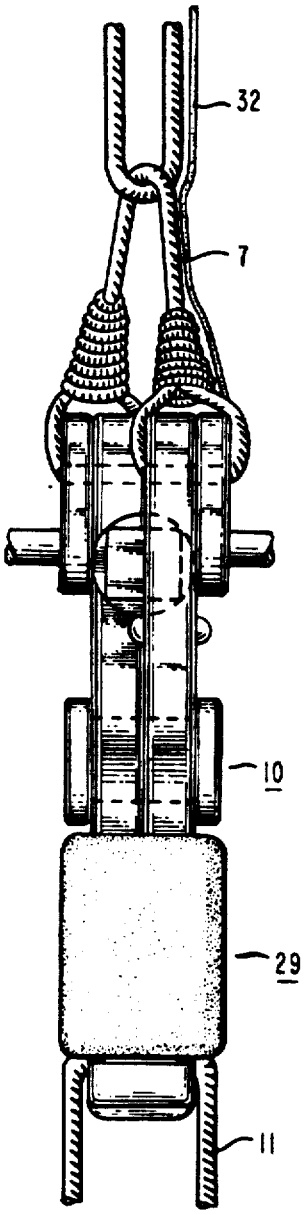
FIG. 7 is a side view thereof.
Figure 15:
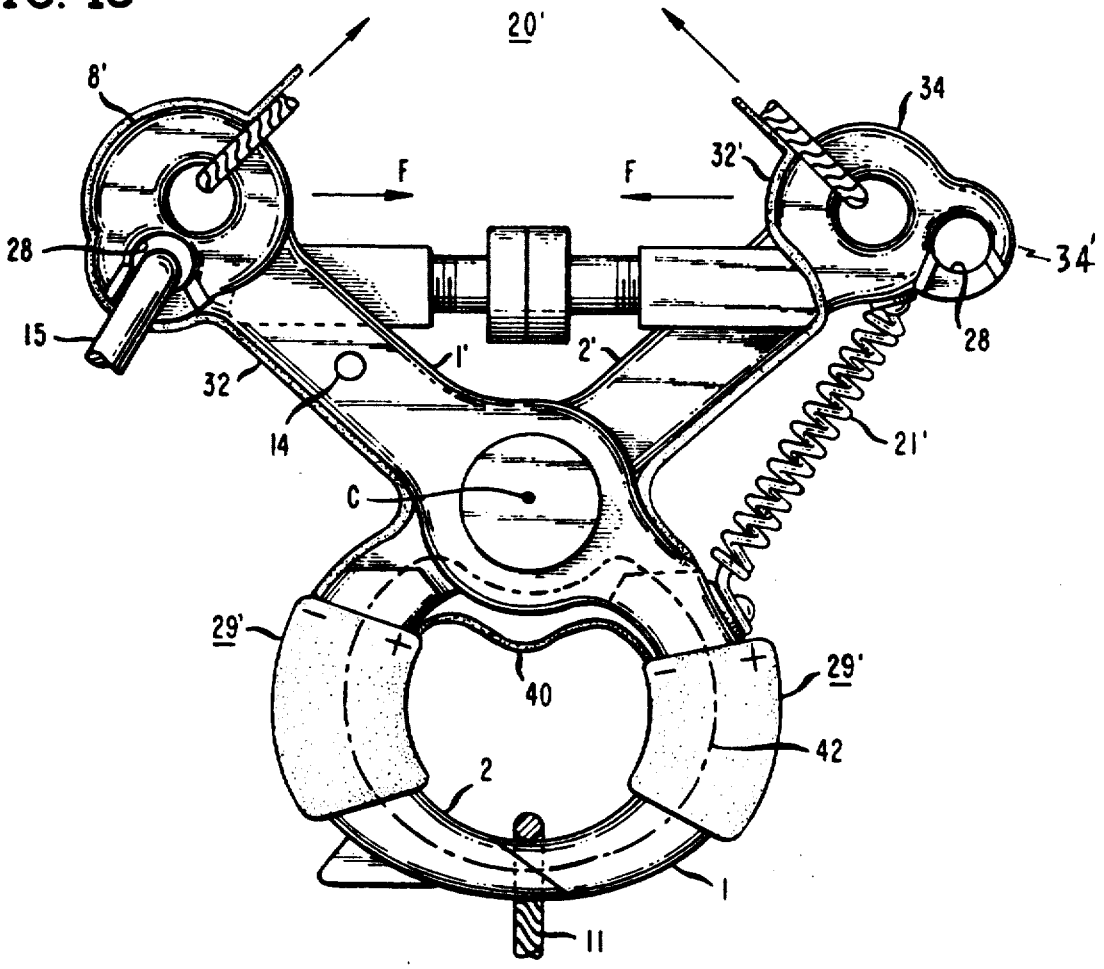
FIG. 15 shows a partial lower view of FIG. 6 showing half of the electromagnet's coil wrapped around one jaw and its other half wrapped around the other jaw, in order to achieve symmetry.

In FIG. 15, coil 31, FIG. 7, is divided into two coils, sharing jaws 1 and 2, to more evenly distribute the weight on device 20. Now each coil assembly is identified as 29' and the two coils are connected in series. Spring 21 has been shortened and renumbered 21', to avoid interference with the coil. Now the weights between the two jaws are more evenly distributed, improving the device's snatching ability and esthetic appearance.

To assure maintenance of uprightness of device 20, a second tubular support member 15' may pass through a similar hole 24' in an enlarged upper weight portion 34, FIGS. 9 and 15. Thus, if the surface on which device 20 rests should be uneven and the first member 15 is unable to assure uprightness, then this second member 15' would help maintain uprightness. There could be a rod 39 between the two members 15, 15', with the rod's one end pivotally fastened to member 15 and its other end pivotally fastened to member 15', in order to maintain a desired separation between the two members. Second member 15' at 34', FIG. 15, is not shown to avoid unnecessary complexity.

Figure 16:
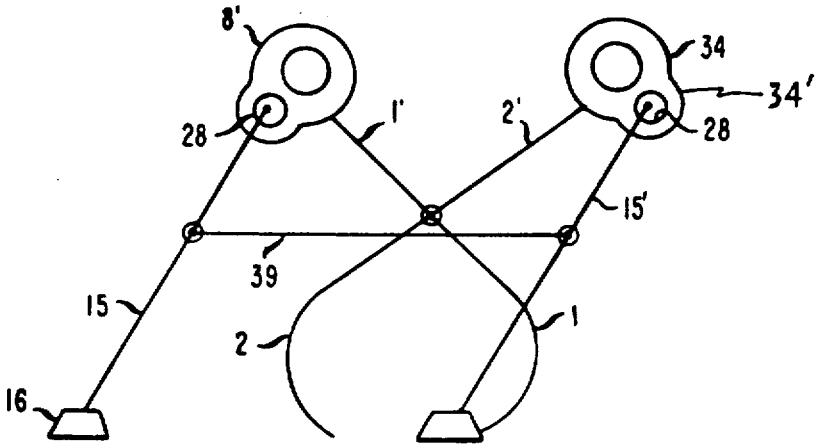
FIG. 16 is a line diagram of two tubular support members, swivelly attached to the device's upper portions, with an interconnecting rod pivotally connected to the members.

In the position that member 15' is shown, FIG. 9, no rod 39 would be connected between the two members, because the two members or standard 15 and 15' are not positioned in the same direction as in FIG. 16. However, should member 15' be swung backwards 60 degrees and appear parallel with member 15, then interconnecting rod 39 could be pivotally fastened between the two, as described above. Then both members could move in unison; that is, both would swing together backward or forward, depending on gravity and other forces present, but not necessarily in parallel.

As an additional improvement, the 200 turns of wire in electromagnet coil 29, FIG. 6, could be evenly divided between the two jaws, as shown in FIG. 15, to avoid making one jaw too large physically. Weight distribution between the two jaws would be improved, too.

CARGO HOOK DEVICE WITH AUTOMATIC LOADING

Another Preferred Embodiment

Figure 17A:
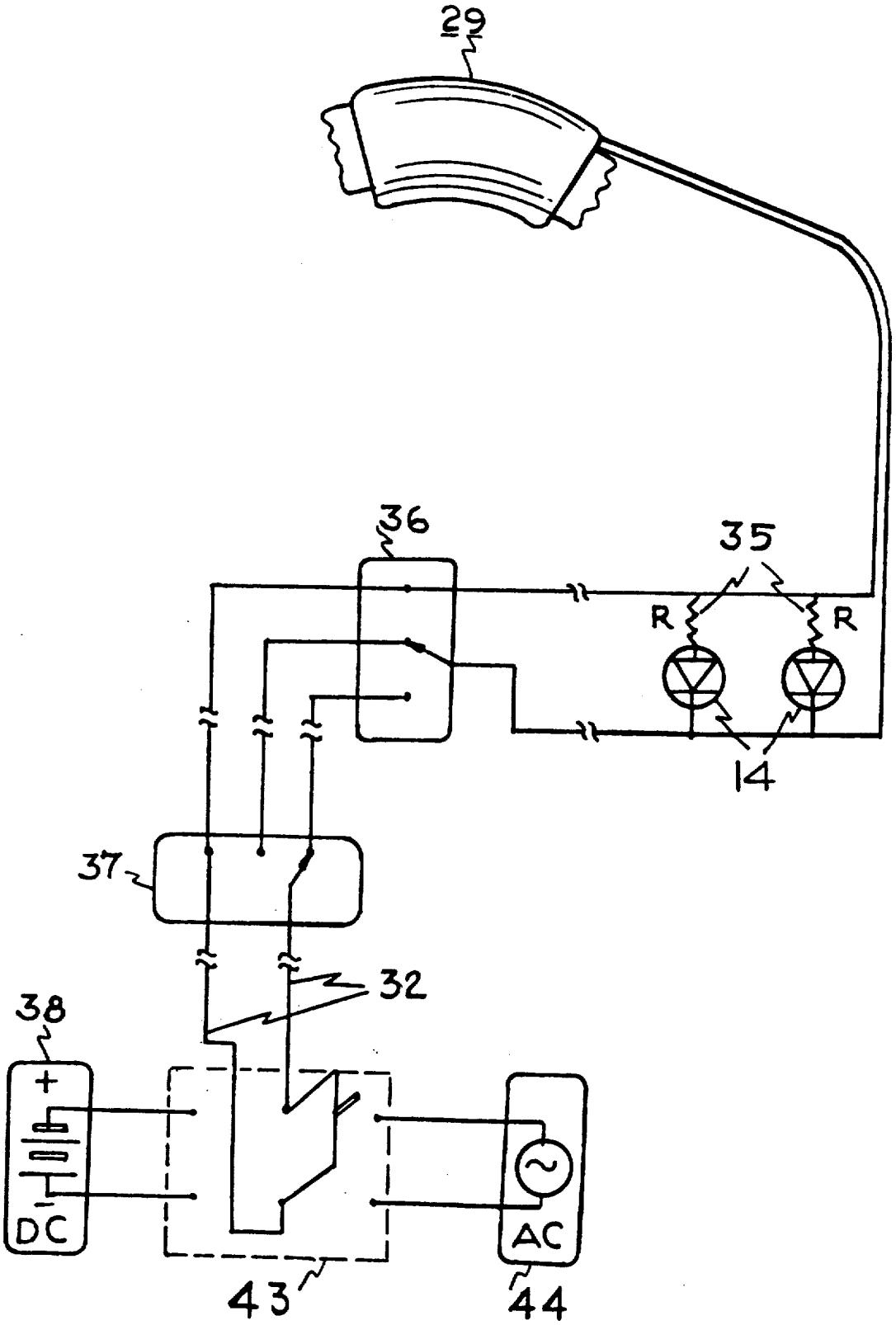
FIG. 17A is an electrical schematic of the circuitry for the electromagnet shown in FIG. 6, with the addition of a double-pole, double-throw switch so that ac voltage can be applied to the electromagnet, thus removing the residual magnetism in the lower portions of the device.

In schematic drawing FIG. 17, a wiring diagram is shown in which DC voltage source 38 is the sole energy source for electromagnet 29, for energizing the component. Now the schematic FIG. 17A is offered as an alternate design. In order to avoid high residual magnetism to exist and remain when the voltage is removed, jaws 1, 2 of device 20 have been slightly modified and an alternating energy source has been added, in order for jaws 1 and 2 to separate instantly when the DC voltage source is turned off. Soft steel was specified in previous patent U.S. Pat. No. 4,717,189, in order for residual magnetism to be a minimum, when the voltage source is switched off. For high strength magnetizable steel to be used for the jaws 1 and 2 with the possibility of high residual magnetism remaining when DC power is turned off, double-throw switch 43 and AC voltage source 44, FIG. 17A, are added. When DPDT switch 43 is toggled to the AC source by the operator of the device, the residual magnetism in the steel is considerably reduced in magnitude, so jaws 1 and 2 can separate easily upon touchdown of device 20.

Figure 19:
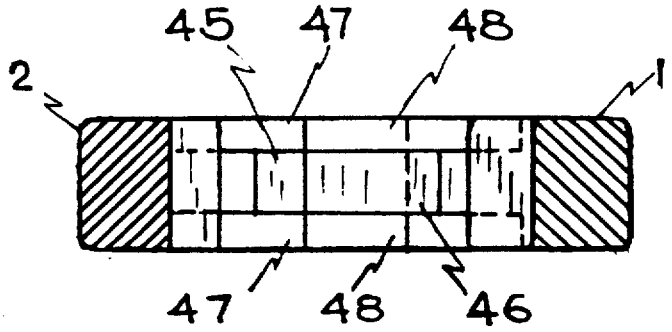
FIG. 19 is a sectional view taken along line 19—19, FIG. 6A, but without the electromagnet and the load cable, showing the location of the stainless steel plates and the soft steel cores. The exterior ends of both the plates and the cores make contact with the device's lower portions.

Another modification in device 20 to minimize retention of residual magnetism in the device's lower portions is to imbed soft steel in the jaws' ends 12 and 13. Only the jaws' outside perimeter would have high strength steel which need not be magnetizable steel. Only soft steel cores 45, 46, need have residual magnetism existing when DC power is turned off. The lower jaw portion 1 and 2 may be thickened to compensate for the lower strength of the soft steel cores 45 and 46. Outside plates 47 and 48 may be welded to the central portions of jaws 1 and 2, at tongue-shaped cores 45, 46, FIG. 20, after removal of exterior material. FIG. 6A shows a modified device with added soft steel cores 45, 46, thickened jaw ends and exterior or outside plates 47 and 48. FIG. 19 is taken along line 19—19, FIG. 6A. With this modified jaws' design, the AC energy source may be avoided.

Figure 22:
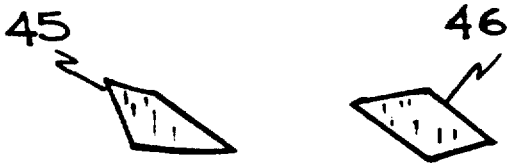
FIG. 22 shows the side views of the soft steel cores by themselves.
Figure 23:
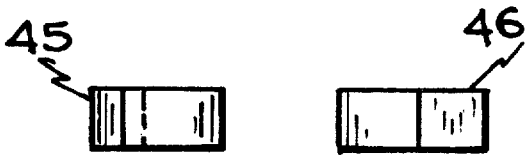
FIG. 23 show the bottom views thereof.

FIGS. 22 and 23 show the front and bottom views of soft steel cores 45 and 46 imbedded in lower jaws 1 and 2. Soft steel does not retain the magnetism when power is removed from the electromagnet 29. Thus, without DC power, jaws 1 and 2 can easily separate upon touchdown.

FIG. 19 is a sectional view taken along line 19—19, FIG. 6A, showing the location of stainless steel plates 47, 48, and cores 45, 46.

Figure 20:
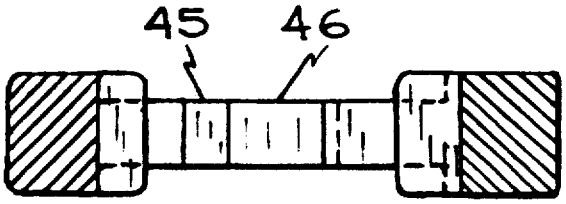
FIG. 20 shows FIG. 19 without the outside plates, in order to show the jaws of the device with just the cores.

FIG. 20 shows FIG. 19 without plates 47 and 48, to assist one in visualizing what the view would look like without plates. Plates 47 and 48 could be welded to both the steel cores 45, 46, and to lower jaws 1 and 2; adhesive and/or rivets could be applied to keep plates 47, 48 and cores 45, 46, in position.

Figure 21:
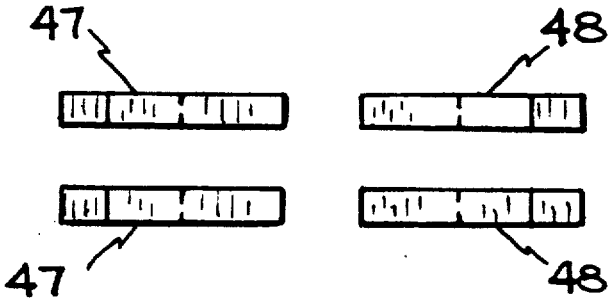
FIG. 21 show the top views of the plates alone.

FIG. 21 shows the four plates 47 and 48 by themselves, while FIG. 22 shows the top view of soft steel cores 45 and 46 by themselves. FIG. 23 is a bottom view of cores 45, 46.

Still Another Preferred Embodiment

Figure 24:
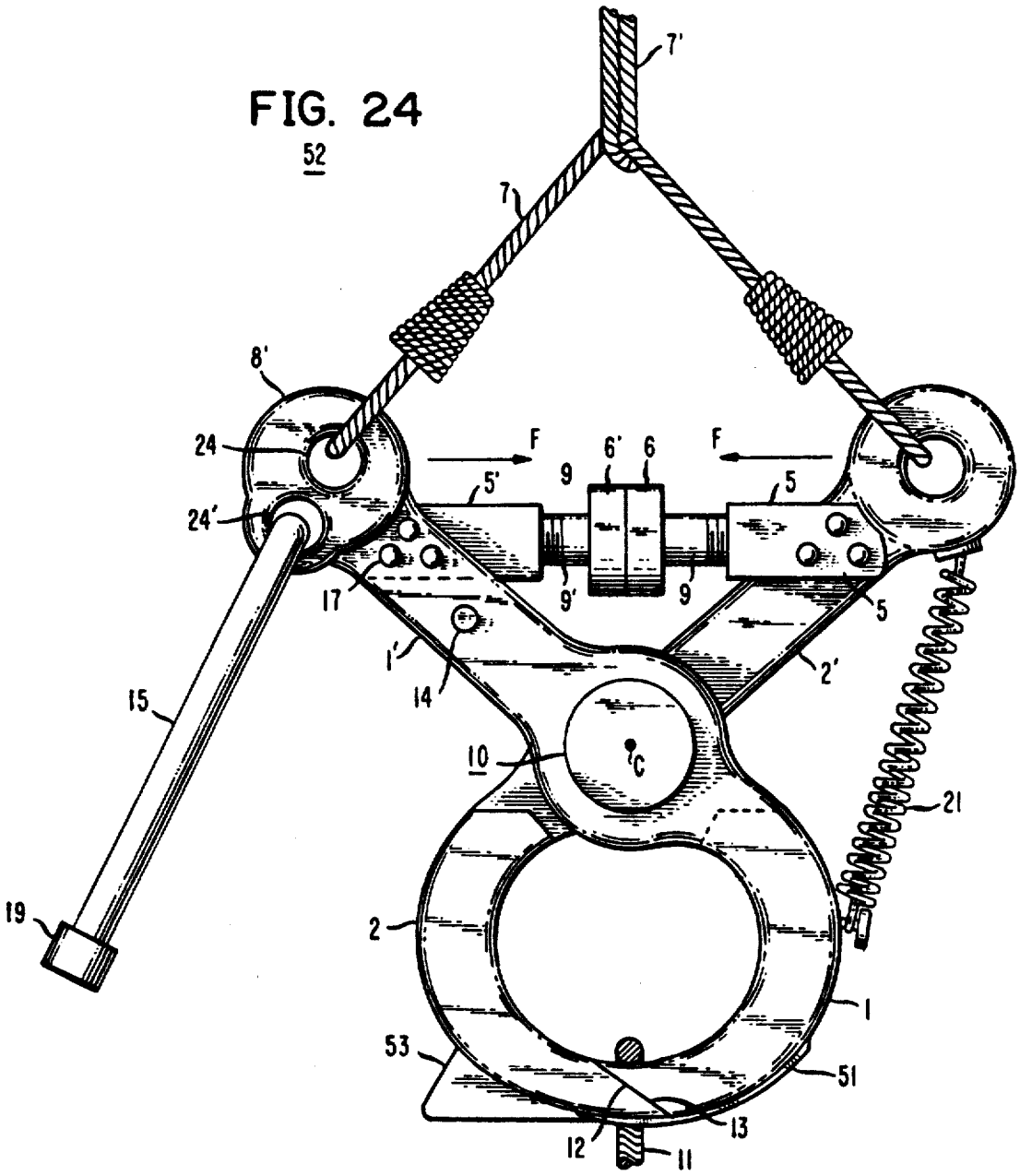
FIG. 24 is an elevational view of the cargo-hook device showing a metal strip located at the underside of one of its jaws with its tongue extending over to the second jaw.

To improve the device's snatching ability for scooping up a load cable, device 52, FIG. 24, is suggested with a fork having two outer blades 54 attached to the underside of jaw 1. Support block 53 is modified to be wider for improved ability for device 52 to stand upright. However, fork member 51 with blades 54 has the same width as the device's jaws, so as to form an exterior continuous contour between jaws 1 and 2 and member 51, smoothly. When jaws 1 and 2 come together, fork member's blades 54 pass underneath jaw 2 and over the end of oversized block support 53, as shown in FIG.

27. Forked member 51 or a single tongue 55, if desired, would have very little thickness and would be fabricated from springy stainless steel. To explain, blades 54 are better able to get underneath a cable than relying only on the end of jaw 1 to do so. FIG. 24 shows the ends of jaws 1 and 2 with block 53 and member 51 fastened to their undersides, as shown, by either cement, welding or small screws or by a combination thereof. In FIG. 24, member 51 is shown cemented by a special adhesive capable of firmly adhering to metal.

Figure 25:
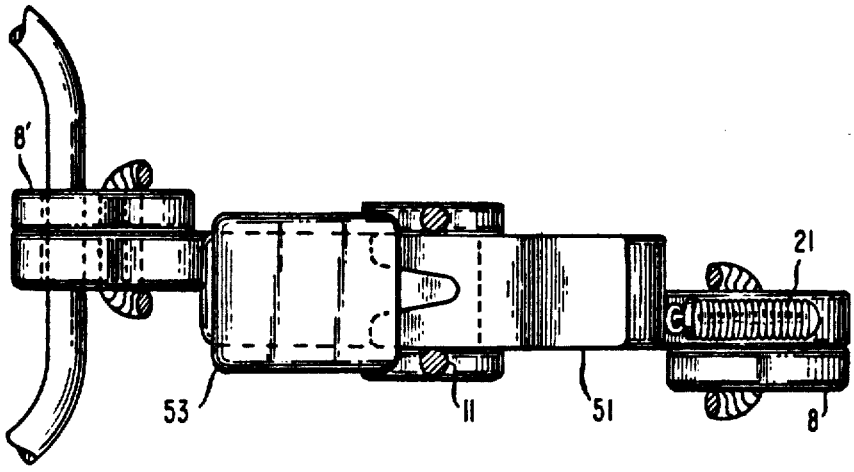
FIG. 25 is a bottom view thereof.
Figure 26:
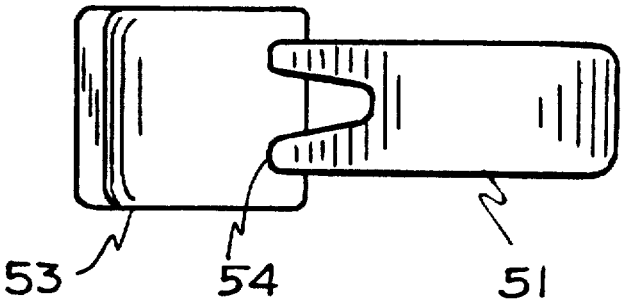
FIG. 26 is a top view of just the metal strip and the device's support block.
Figure 27:
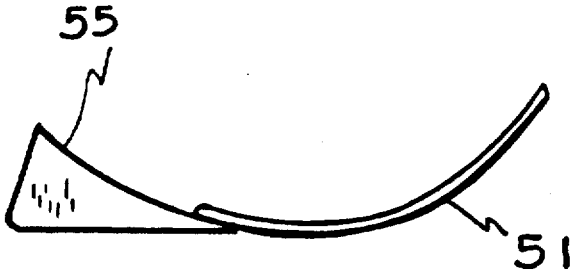
FIG. 27 is a side view thereof.
Figure 28:
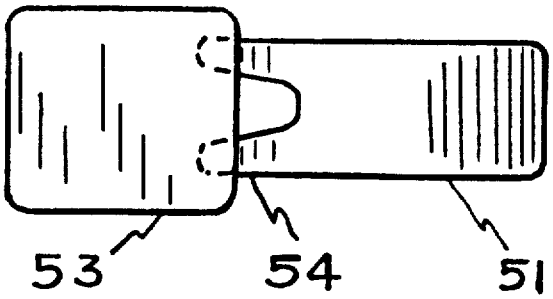
FIG. 28 is a bottom view thereof.

FIG. 25 shows the underside of jaws 1 and 2 with block 53 fastened to jaw 2 and member 51 fastened to jaw 1. There are no modifications needed for either jaw 1 or jaw 2. FIGS. 26 to 28 show the top, side and bottom views of block 53 and member 51 in engagement position. Member 51's fork blades 54 are shown engaging on top of block 53, FIG. 27, and underneath end 12, FIG. 24.

The above described design should enable device 52 to be better able to scoop underneath cable 11 and place it on top of the jaw ends, shown in FIG. 24.

Figure 29:
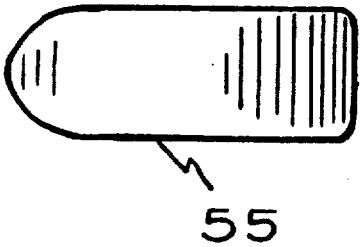
FIG. 29 shows a bottom view of the solid metal strip, showing the protruding tongue.

FIG. 29 shows a tongue-shaped member 55 substituting for forked member 51. The advantage of the tongue-shaped front end of member 55 is its improved ability to withstand bending and not being disshaped thereby.

Description of Flexible Length Legs of Cargo Hook Tubing

Figure 31:
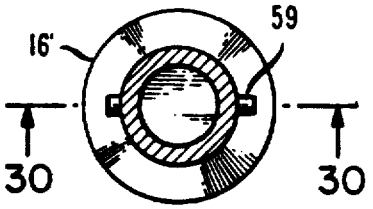
FIG. 31 is a sectional view of the lower portion of the tubular support member along line 31—31 of FIG. 32.
Figure 30:
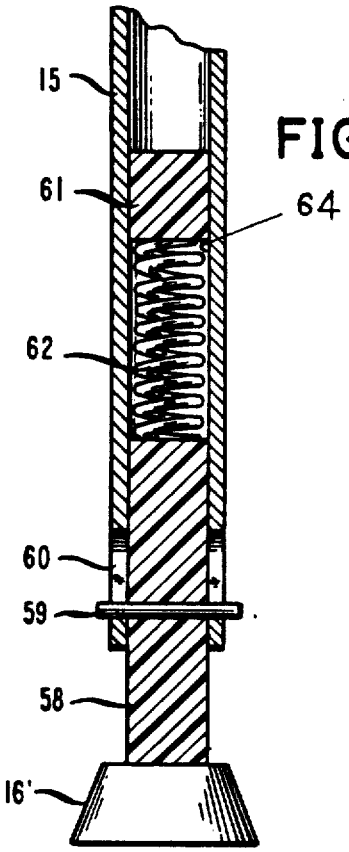
FIG. 30 shows a sectional view taken along line 30—30 of FIG. 31.

It is sometimes desirable to have a combination shock-absorbing capability and leg-length flexibility for cargo hook device 20, FIG. 1. Should the cargo-hook device land on a very uneven, hard surface it would be desirable to have two or more of the legs of tubing 15 flexible in length to enable the device to remain upright upon touchdown, without damage to the device itself. In FIG. 30, the flexibility in length is achieved by using an inner plastic rod 58 with a coil spring 62 having damping capability to avoid unnecessary bouncing of support tubing 15. FIG. 30 is a sectional view taken along line 30—30 of FIG. 31, showing the modified design of the leg of tubing, typical of the other legs so modified and designed to absorb shock and enable the device to remain erect on an uneven surface. FIG. 31 is a sectional view taken along line 31—31 of FIG. 32, showing an end view of pin 59.

In FIG. 30, tubing 15 is shown with the coil spring inside the tubing, an inner plastic rod 58, telescoping within tubing 15 whose longitudinal motion is limited along tubing 15 by slot 60 and tapered pin 59, which also retains rod 58 within tubing 15.

A resilient cone-shaped foot 16' is fastened to the bottom end of rod 58, to provide additional cushioning when leg 15 makes impact with a hard surface. Spring 62 is limited in its vertical movement by stopper 61, which could be fabricated of durable plastic.

Spring 62's oscillatory motion upon making contact with an uneven surface may be dampened by using a compressible fluid, as used in automoble shock absorbers, or by using a gooey, sticky or viscous substance 64 along the upper portion of the interior surface of tubing 15 at the location of spring 62.

It is recommended that four legs of tubing be used as indicated in FIG. 15, rather than just two legs, as shown in FIG. 1, to be assured that at least two of the legs will make contact with a surface when device 20 makes touchdown.

The above technique for enabling device to remain upright without experiencing damage upon impact is simple in design, uncomplicated in approach and a feasible solution to the problem described.

Figure 33:
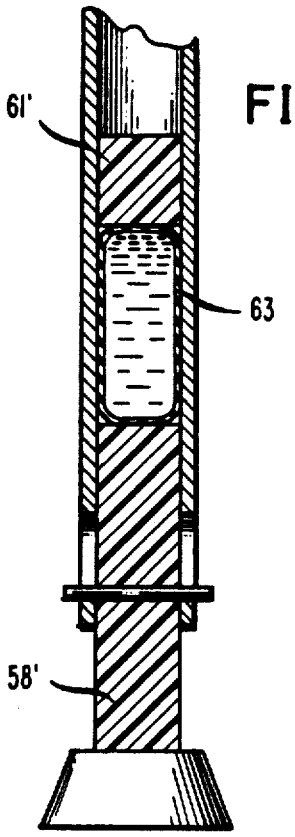
FIG. 33 shows a sectional view taken along line 30—30 of FIG. 31, but with an inflated container in place of a spring.

As an alternate technique to spring 62, FIG. 30, for providing both shock absorption and flexible length to leg 58, an inflated container of fluid 63 is provided and shown in FIG. 33. Container 63 is located between plastic rods 58' and 61'. All other parts of FIG. 33 are identical to those of FIG. 30. The advantage to the flexible, compressible container 63 is that a viscous substance could be added to the compressible fluid to promote damping, and the substance would be sealed inside the container without any leakage of the substance possible. Another technique would be to use an inflatable container possessing damping characteristics, so that a viscous subtance need not be added to the fluid. The length of container 63 is not shown to scale; it could be twice as long as shown. The fluid could be air. Container 63 provides the desired damping to avoid undesirable bounce to legs 15 upon impact, while absorbing the impact shock of either device 20 or 52 making touchdown on a rigid surface.

FIG. 32 shows tubing 15 with its two legs and hoofs 16'. Note that the legs of tubing are spread apart to assist device 20 or 20' to stand upright upon touchdown. Oilite, plastic rings or grommets 25 fastened to tubing 15, retain upper portions 1' and 2' centrally positioned at the top horizontal portion of tubing 15. The rings 25 are positioned in place after the tubing's insertion in hole 24' and before hoofs 16' and pins 59 are installed at or near the ends of tubing 15, Pin 59 is fastened to rod 58.

Referring to FIG. 30, another way to acquire spring damping, if required, is to pack grease of the desired viscosity in the coil spring space with spring 62 compressed. Then when spring 62 is allowed to expand, the grease will retard the expansion rate as well as the rate of compression, thus avoiding any undesirable bouncing of leg 58 upon impact on a hard surface. Length of coil spring 62 is not shown to scale; it could be twice as long as shown in FIG. 30.

I claim:

1. A tongs-like cargo-hook device for quickly scooping up and releasing suspended cargo automatically from a platform having a rigid surface, comprising a tongs-like part having two elongated members, a hub and a pivot pin for pivoting said members near their mid-section, for use with a hoisting mechanism having hoist cables and a load cable, each cable being adapted for attachment to said part, said members having upper and lower portions, the upper portion of one member provided with a hole, and each of said upper portions having a weight on top to assist in forcing the separation of said portions upon touchdown of said cargo upon said platform, said lower portions, including jaws, having complementary-shaped beveled jaw ends which close against each other end to end to form a smooth continuous contour when supporting said cargo because of the tension on said hoist cables, said upper portions having inside surfaces with a bar fastened horizontally to each of said inside surfaces, each bar having a hammerhead at one end, and each said hammerhead extending inward toward the other, said hammerheads when abutting sharing the structural stresses imposed on said complementary-shaped ends when supporting said cargo, wherein the improvement comprises the addition of a tubular inverted U-shaped standard to assist the device to remain upright on touchdown, said standard passing through the hole in said upper portion and swivelly attached thereto to enable said device to remain upright upon touchdown by the two legs formed by said standard, each of said legs carrying a resilient hoof, said legs being bent sufficiently and of sufficient length on each side of device's upper portion so that each said hoof can make contact with said surface when said device releases said load cable.

2. A cargo-hook device in accordance with claim 1, and wherein both said upper portions are provided with a hole, and a tubular inverted U-shaped standard passing through the hole in each of said upper portions and swivelly attached thereto, to provide additional assistance to the device to remain upright upon touchdown by the four legs formed by two such said standards, with each of said legs having said hoof attached, whereby regardless of the levelness of said surface below, said device remains upright, and therefore able to snatch said load cable, or unload said load cable, upon touchdown.

3. A cargo hook device in accordance with claim 1, wherein the improvement to provide positive load retention in said part comprises both said lower portions and said hub, said hub being of magetizable steel, and forming a magnetizable loop for low reluctance passage of magnetic lines of force for maintaining engagement of said complementary-shaped ends; for providing magnetic lines, one of said lower portions having an integrated electromagnet with exciting coils, which when excited with an applied voltage via a switch produces magnetic attraction between said ends of said lower portions, keeping them in engagement; the wires of said exciting coils having insulated surfaces and wrapped around one of said lower portions with the required number of turns so as to produce the desired magnitude of attraction between said ends for the magnitude of current flowing through said coils to maintain said ends' engagement, said coils' exterior being structurally protected by a shield of nonmagnetic, non-magnetizable material; whereby only when said applied voltage is removed, can said ends disengage and allow said load cable to be released; thereby positive load retention for said device being achieved when voltage is applied; said positive load retention being removed when said voltage is switched off; each of said jaws being fabricated of soft steel so that said steel's residual magnetism is minimized, to permit said jaws' disengagement.

4. A cargo-hook device in accordance with claim 3, wherein said exciting coils are applied to both of said lower portions with said required number of turns and wherein said coils are divided equally between said lower portions and connected in series, thus aiding in producing magnetic lines of force, whereby approximate equal distribution of weight is achieved between said lower portions, providing less interference to said load cable and improving esthetic appearance of said device, with equal distribution of weight making for a better weight balance, thereby said device can more ably snatch a load cable upon lift-off, because said hoist cables being better able to manipulate both said device and said load cable into an unloading position, or into a loading position.

5. A cargo-hook device in accordance with claim 3, and wherein the improvement comprises said part being completely fabricated of high strength magnetizable steel for safe, heavy load lifting and transporting; a dc voltage source being applied to the coils of said electromagnet for positive load retention of said suspended cargo; and via a double-pole, double throw switch, an ac voltage source being applied for removing high residual magnetism in said steel, and allowing said jaws of said device to release said load cable.

6. A tongs-like, cargo-hook device in accordance with claim 1 wherein each said lower portion having an underneath and an upper surface and wherein the improvement for automatically snatching of said load cable comprises said part having a thin springy metal tongue attached to said underneath surface of a lower portion such that when said jaws come together, said tongue's end passing underneath one said lower portion with said tongue also reaching underneath said load cable lifting said cable on top of said other lower portion's upper surface, thus reliably and properly snatching said load cable upon lifting said device from said platform.

7. A cargo hook device in accordance with claim 6, and wherein said tongue is forked for improved resiliency and springness to more easily enable said device to perform the task of scooping up and lifting said load cable from a horizontal surface to said upper surface of said other lower portion reliably.

8. A cargo-hook device in accordance with claim 1, and wherein length-flexibility means is introduced in at least two of said legs of said tubing to improve the ability of said device to stand upright upon landing on a very uneven, rigid surface, said means comprising an inner telescoping plastic rod, a coil spring within said tubing, stops for limiting the longitudinal motion of said rod, said hoof being attached to the exterior end of said rod; said spring being limited in its longitudinal motion by longitudinal slots in said tubing by a cross pin in said rod protruding through said slots, whereby before said device's jaws make contact on said rigid surface, said flexible-length legs making contact on said rigid surface and absorbing the shock of impact while assisting said device to remain upright upon touchdown, said spring being provided with a damping substance to avoid unnecessary bouncing of said hoof on said surface.

9. A cargo-hook device in accordance with claim 8 wherein each of said legs being provided with a telescoping plastic rod and said spring of each of said device's legs being provided with a nonfluidic damping means, said means including said tubing's interior surface being roughened at the location of said spring and a nonflowing viscous damping substance applied to said interior surface, whereby said substance adhering well to said interior surface introduces the needed spring damping to avoid undesirable bouncing on said rigid surface.

10. A cargo-hook device in accordance with claim 8, and wherein said length-flexibility means is introduced in said legs by a sealed, stretchable, flexible container filled with compressible fluid, said container being fabricated of material having damping properties as well as being impervious to said fluid, said container providing the desired damping to avoid undesirable bounce to said legs upon impact, while absorbing the impact shock when said device makes high velocity touchdown on said rigid surface.

11. A cargo hook device in accordance with claim 1, and wherein each of said upper and lower portions has an exterior surface and wherein the improvement to help separate said jaws upon touchdown of said cargo first comprises the addition of an extension coil spring having one end fastened to the exterior surface of one of said upper portions and its other end fastened to the exterior surface of the lower portion, below the upper portion to which one end of the spring is fastened; and wherein the second improvement comprises in said spring having a waterproof protective sleeve to protect said spring from mud, small rocks, dirt and chemicals, and damaging said spring, thereby preventing it from functioning as designed; whereby said first improvement reduces the magnitude of said weight on top, enabling the weight of said device to be reduced.

12. A tongs-like, cargo-hook device, for scooping up and releasing suspended cargo automatically from a platform, having back-up load retention means, comprising a tongs-like part, having two elongated members, pivoted near their midsection by a pivot pin inside a hub, for use with a hoisting mechanism having hoist cables and a load cable, each cable being adapted for attachment to said part, said members having upper and lower portions, at least one of said lower portions having an integrated electromagnet, and each of said upper portions having a weight on top to assist in forcing the separation of said portions upon touchdown of said cargo upon said platform; said lower portions, including jaws having complementary-shaped beveled ends, which close against each other to form a smooth continuous contour when supporting said cargo, because of the tension on said hoist cables, said upper portions having inside surfaces with a bar fastened horizontally to each of said inside surfaces, each bar having a hammerhead at one end, and each hammerhead extending inward toward the other, said hammerheads when abutting sharing the structural stressors imposed on said complementary-shaped ends when supporting said cargo, wherein the addition of said electromagnet integrated to one of said lower portions comprises one improvement, said part being fabricated of high strength magnetizable ferrous steel, except for each of said jaws being fabricated with a soft steel core, said core sandwiched between high strength non-magnetizable steel plates, the ends of both said core and said steel plates forming a smooth continuous contour being the other improvement, so that when said complementary-shaped ends close together, both said core and said plates make smooth physical contact; thus, when applying a dc voltage source to said integrated electromagnet, a continuous magnetic circuit occurs via said pin's hub, said lower portions and said core; whereby when said source of voltage is removed, said core retaining negligible residual magnetism; with said construction only a dc voltage source being needed to keep said jaws of said lower portions in contact, and allowing said jaws to separate when said voltage source is removed.

* * * * *